United States Patent [19]

Kadija

[11] 4,370,214

[45] Jan. 25, 1983

[54] RETICULATE ELECTRODE FOR ELECTROLYTIC CELLS

[75] Inventor: Igor V. Kadija, Cleveland, Tenn.

[73] Assignee: Olin Corporation, New Haven, Conn.

[21] Appl. No.: 143,970

[22] Filed: Apr. 25, 1980

[51] Int. Cl.[3] ..... C25B 11/03; C25B 11/04; H01M 4/90; H01M 4/80

[52] U.S. Cl. ..... 204/242; 204/284; 204/290 R; 429/42; 429/44; 429/236

[58] Field of Search ..... 429/42, 44, 236; 204/242, 284, 290 R

[56] References Cited

U.S. PATENT DOCUMENTS

| | | | |
|---|---|---|---|
| 745,274 | 11/1903 | Buhne | 429/237 |
| 3,867,174 | 2/1975 | Maekawa et al. | 204/30 X |
| 4,046,664 | 9/1977 | Fleet et al. | 204/280 |

FOREIGN PATENT DOCUMENTS

| | | | |
|---|---|---|---|
| 1277966 | 9/1968 | Fed. Rep. of Germany | 429/236 |
| 2214412 | 10/1973 | Fed. Rep. of Germany | 429/44 |
| 1443354 | 7/1976 | United Kingdom | 429/42 |

OTHER PUBLICATIONS

Tentorio et al, J. Applied Electrochem., vol. 8, pp. 195–205, (1978).

Volkman, Electrochem. Acta, vol. 24, pp. 1145–1149, (1979).

*Primary Examiner*—F. Edmundson

*Attorney, Agent, or Firm*—James B. Haglind; Donald F. Clements

[57] ABSTRACT

An electrode for use in the electrolysis of aqueous solutions of ionizable compounds is produced by a method which comprises affixing filaments to a support fabric to form a network of filaments. An electroconductive metal is deposted on the filaments to form metal coated filaments. During the metal deposition, interfilament bonding takes place at contact sites between adjacent filaments. Removing the support fabric from the metal coated filament network produces a reticulate electrode having a porosity of at least about 80 percent. The three dimensional electrodes are highly conductive, have high internal surface area, and are mechanically strong.

11 Claims, 2 Drawing Figures

RETICULATE ELECTRODE FOR ELECTROLYTIC CELLS

This invention relates to electrodes for use in electrolytic cells. More particularly, this invention relates to electrodes for electrolytic cells having high surface areas.

In electrolytic cells employed in the electrolysis of aqueous solutions of ionizable compounds such as alkali metal chlorides, foraminous metal electrodes are used which are constructed of perforated plates, meshes or screens, and expanded metals. These electrodes employ significant amounts of metal and have a high ratio of metal weight to surface area and significant polarization values. As the cost of electric power has increased, various ways have been sought to increase the surface area of these electrodes and to reduce their polarization values and thus lower the power consumption for their operation.

One method of reducing polarization values of these prior art electrodes is to employ expensive catalysts to reduce the electrode charge transfer activation barrier. Using these materials, any savings resulting from a reduction of power consumption has been offset by the increase in costs for the electrodes. In addition, these catalysts have a relatively short operational life.

A more recent attempt to increase the surface area of electrodes has been the development of the three dimensional electrodes such as reticulate electrodes. A Tentorio and U. Casolo-Ginelli have described one type of reticulate electrode (J. Applied Electro-Chemistry 8, 195–205, 1978) in which an expanded reticulated polyurethane foam was metallized by means of the electroless plating of copper. A thin layer of copper (about 0.34 m) was formed which conferred electrical conductivity to the matrix. Galvanic plating was employed to deposit additional amounts of copper. The reticulate electrode was employed in a cell for the electrolysis of a copper sulfate solution. This reticulate electrode, however, requires two separate electroplating operations which increases both the time required and the cost of fabrication. In addition, the geometrical configuration of the foam makes it difficult to obtain uniform coating of the substrate.

There is a need for electrodes for electrolytic cells having increased surface area to reduce electrical power consumption while requiring smaller amounts of the electroconductive metal and employing efficient fabrication methods.

It is an object of the present invention to provide an electrode for electrolytical cells having increased surface area.

Another object of the present invention is to provide an electrode for electrolytical cells which is highly porous.

A further object of the present invention is to provide an electrode for electrolytic cells having reduced electrical power consumption.

An additional object of the present invention is to provide an electrode for electrolytic cells having reduced amounts of electroconductive metal.

These and other objects of the invention are accomplished in an electrode for use in the electrolysis of aqueous solutions of ionizable compounds by the method which comprises:

(a) affixing filaments to a support fabric to form a network of filaments, (b) depositing an electroconductive metal on said filaments to form metal coated filaments, said deposition providing interfilament bonding at contact sites between adjacent filaments, and (c) removing said support fabric from said metal coated filament network to produce a reticulate electrode having a porosity of at least about 80 percent.

Other advantages of the invention will become apparent upon reading the description below and the invention will be better understood by reference to the attached FIGURES.

Figure 1:
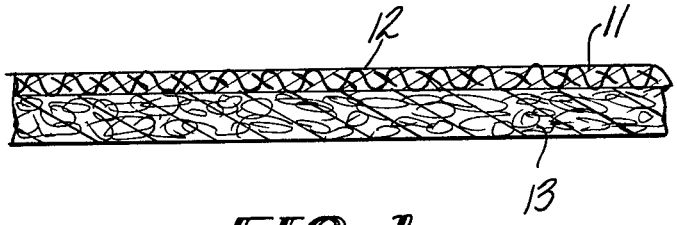
FIG. 1 is a sectional view of a portion of the fabric structure prior to depositing the electroconductive metal.

FIG. 1 shows a web 11 containing filaments 12. Web 11 is attached to support fabric 13.

Figure 2:
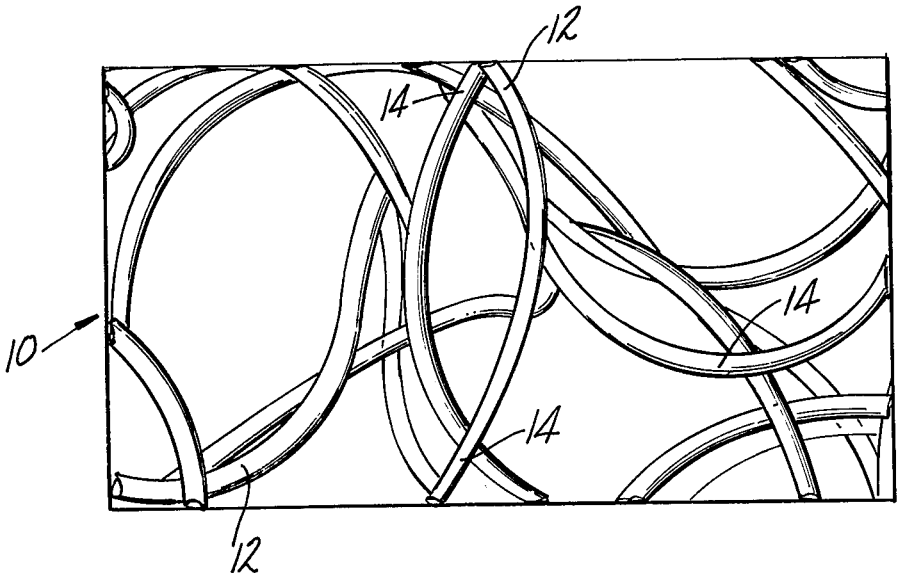
FIG. 2 illustrates a portion of a reticulate electrode of the present invention having a magnification of 100 times the original.

FIG. 2 shows a portion of reticulate electrode 10 comprised of a plurality of filaments 12 coated with an electroconductive metal after removal of support fabric 13. Interfilament bonding has taken place at sites 14.

More in detail, the novel electrodes of the present invention comprise filaments which can be suitably affixed to a support fabric.

The term "filaments" as used in this specification includes fibers, threads, or fibrils. The filaments may be those of the electroconductive metals themselves, for example, nickel, titanium, or steel; or of materials which can be coated with an electroconductive metal.

Any materials which can be electroplated with these electroconductive metals may be used. Suitable materials include, for example, metals such as silver or copper, plastics such as polyarylene sulfides, polyolefins produced from olefins having 2 to about 6 carbon atoms and their chloro- and fluoro- derivatives, nylon, melamine, acrylonitrile-butadiene-styrene (ABS), and mixtures thereof.

Where the filaments to be coated are non-conductive to electricity, it may be necessary to sensitize the filaments by applying a metal such as silver, nickel, aluminum, palladium, or their alloys by known procedures. The electroconductive metals are then deposited on the sensitized filaments.

The filaments are affixed to a support fabric prior to the deposition of the electroconductive metal. Any fabric may be used as the support fabric which can be removed from the reticulate electrode structure either mechanically or chemically. Support fabrics include those which are woven or non-woven and can be made of natural fibers such as cotton or rayon or synthetic fibers including polyesters, nylons, polyolefins such as polyethylene, polypropylene, polybutylene, polytetrafluoroethylene, or fluorinated ethylenepropylene (FEP) and polyarylene compounds such as polyphenylene sulfide. Preferred as support fabrics are those of synthetic fibers such as polyesters or nylon. Fabric weights of 100 grams per square meter or higher are quite suitable for the support fabrics.

Filaments are affixed to the support fabric in arrangements which provide a web or network having the desired porosity. The filaments are preferably randomly distributed while having a plurality of contact points with adjacent filaments. This can be accomplished by affixing individual filaments in the desired arrangement or by providing a substrate which includes the filaments. Suitable substrates are lightweight fabrics having a fabric weight in the range of from about 4 to about 75 grams per square meter. A preferred embodiment of the substrate is a web fabric of, for example, a polyester or nylon.

Filaments may be affixed to the support fabric or the substrate, for example, by sewing or needling. Where the filaments are affixed to a thermoplastic material, energy sources such as heat or ultrasonic waves may be employed. It may also be possible to affix the filaments by the use of an adhesive.

An electroconductive metal is then deposited on the filaments, for example, by electroplating. Any electroconductive metal may be used which is stable to the cell environment in which the electrode will be used and which does not interact with other cell components.

Examples of suitable electroconductive metals include nickel, nickel alloys, molybdenum, molybdenum alloys, vanadium, vanadium alloys, iron, iron alloys, cobalt, cobalt alloys, magnesium, magnesium alloys, tungsten, tungsten alloys, gold, gold alloys, platinum group metals, and platinum group metal alloys. The term "platinum group metal" as used in the specification means an element of the group consisting of platinum, ruthenium, rhodium, palladium, osmium, and iridium.

Preferred electroconductive metals are nickel and nickel alloys, molybdenum and molybdenum alloys, cobalt and cobalt alloys, and plwhere the electrode will contact an ionizable compound such as an alkali metal hydroxide, the electroconductive metal coating be that of nickel or nickel alloys, molybdenum and molybdenum alloys, cobalt and cobalt alloys. Where the electrode will contact an ionizable compound such as an alkali metal chloride, the electroconductive metal coating be that of a platinum group metal or an alloy of a platinum group metal.

During the deposition of the electroconductive metal, interfilament bonding occurs where the filaments contact each other as the deposited metal "grows" over and encloses the contact site. As there are many contact sites between filaments in the structure, interfilament bonding occurs frequently and the electrode structure produced is mechanically strong.

Sufficient amounts of the electroconductive metal are deposited on the filaments to produce an electrode structure having adequate mechanical strength and which is sufficiently ductible to withstand the stresses and strains exerted upon it during its use in electrolytic processes without cracking or breaking. Suitable amounts of electroconductive metals include those which increase the diameter of the filaments up to about 5 times and preferably from about 2 to about 4 times the original diameter of the filaments. While greater amounts of electroconductive may be deposited on the filaments, the coated filaments tend to become brittle and to powderize. Prior to the deposition of the electroconductive metal, the filaments have diameters in the range of from about 1 to about 100, preferably from about 2 to about 50, and more preferably from about 5 to about 15 microns. Following the deposition of the electroconductive metal, the filaments have diameters in the range of from about 2 to about 200, preferably from about 6 to about 150, and more preferably from about 15 to about 75 microns.

After deposition of the electroconductive metal has been accomplished, the support fabric is removed. With cloth-like fabrics, these can be readily peeled off or cut off the metal structure. Non-woven or felt support fabrics can be, for example, loosened or dissolved in solvents including bases such as alkali metal hydroxide solutions or acids such as hydrochloric acid. Any solvent may be used to remove the support fabrics and substrates which will not corrode or detrimentally effect the electrode structure. Heating may also be employed, if desired, to remove the support fabrics. Where a substrate containing the filaments is used, the temperature to which the metal coated electrode is heated should be less than the melting point or decomposition temperature of the substrate.

The novel reticulate electrode produced is highly porous, having a porosity above about 80 percent, preferably above about 90 percent, and more preferably in the range of from about 95 to about 98 percent. The porosity is defined as the ratio of the void to the total volume of the reticulate electrode. These three dimensional electrodes provide high internal surface area, are highly conductive, and are mechanically strong while employing greatly reduced amounts of the electroconductive metal. For example, reticulate nickel electrodes of the present invention contain from about 2 to about 50, and preferably from about 10 to about 20 percent of the weight of conventional nickel mesh electrodes. For example, nickel reticulate electrodes have an average weight of from about 200 to about 5,000, preferably from about 300 to about 3,000, and more preferably from about 400 to about 1,200 grams of nickel per square meter.

The novel reticulate electrodes of the present invention have greatly reduced material costs than the foraminous metal electrodes presently being used commercially.

Electrolytic cells in which the reticulate electrodes of the present invention may be used include those which are employed commercially in the production of chlorine and alkali metal hydroxides by the electrolysis of alkali metal chloride brines. Alkali metal chloride brines electrolyzed are aqueous solutions having high concentrations of the alkali metal chlorides. For example, where sodium chloride is the alkali metal chloride, suitable concentrations include brines having from about 200 to about 350, and preferably from about 250 to about 320 grams per liter of NaCl. Where the electroconductive metal deposited is platinum, the reticulate electrodes may be suitably employed as the anodes. Nickel reticulate electrodes of the present invention may serve as the cathodes. These cells may employ electrolyte permeable diaphragms, solid polymer diaphragms, or ion exchange membranes to separate the anodes from the cathodes and include monopolar and bipolar type cells including the filter press type. Reticulate anodes of the present invention may also be employed in cells having a mercury cathode.

Reticulate electrodes of the present invention may also be used, for example, in from alkali metal hydroxides.

The novel reticulate electrodes of the present invention are illustrated by the following examples without any intention of being limited thereby.

EXAMPLE 1

A web of silver coated nylon fibers (20 grams per square meter; fiber diameter about 10 microns) was needled onto a section of a polyester cloth (250 grams per square meter; air permeability 50 cubic meters per minute per square meter). A current distributor was attached to the web and the web-polyester cloth composite was immersed in an electroplating bath containing 450 grams per liter of nickel sulfamate and 30 grams per liter of boric acid at a pH in the range of 3–5. Initially electric current was passed through the solution at a current density of about 0.2 KA/m2 of electrode surface. After about 10 minutes, the current was increased to provide a current density of 0.5 KA/m2. During the electroplating period of about 3 hours, an electroconductive nickel coating was deposited on the silver fibers. Where adjacent fibers touched, plated joints formed to bond the fibers together into a network of the type illustrated in FIG. 2. After removal from the plating bath, the nickel plated structure was rinsed in water. The current distributor and the polyester fabric were peeled off and an integrated nickel plated structure obtained having a porosity of 96 percent and weight of 580–620 grams per square meter in which the nickel coated fibers had a diameter, on the average, about 30 microns. To determine its polarization characteristics, the nickel plated structure was employed as an electrode in a cell containing a standard calomel electrode and an aqueous solution of sodium hydroxide (35% by weight of NaOH) at 90° C. As an electrode, the nickel plated structure was mechanically strong and did not require reinforcing or supporting elements. An electric current of 2.0 KA/m2 was passed through the cell and the polarization value determined. The results are recorded in Table 1 below.

COMPARATIVE EXAMPLE A

The polarization characteristics of a nickel louvered mesh having an average weight in the range of 6,000–10,000 grams per square meter were determined by installing the nickel mesh in the cell of EXAMPLE 1. The polarization value obtained is recorded in Table 1 below.

TABLE 1

| Nickel Electrode Of | Polarization Values |
|---|---|
| EXAMPLE 1 | −1.470 v ± 10 mv |
| COMPARATIVE EXAMPLE A | −1.570 v ± 10 mv |

As shown in the above Table, the novel nickel electrode of EXAMPLE 1 has a polarization value of 100 millivolts below that of the nickel mesh electrode. This drop in the polarization value is attributed to the larger surface area of the electrode of EXAMPLE 1 exposed to the electric current over that of the nickel mesh electrode of COMPARATIVE EXAMPLE A.

EXAMPLE 2

A silver coated nylon web of the type employed in EXAMPLE 1 was needled into a section of a polyester felt fabric (190 grams per square meter). The silver sensitized felt fabric was then plated with nickel using the electroplating procedure of EXAMPLE 1. The plating procedure produced an integrated structure of nickel coated fibers bonded by a plurality of plated joints connecting portions of adjacent fibers. The plated structure had a porosity of 98 percent and weight of 780 to 840 grams per square meter. After rinsing with water, the nickel structure was immersed in an aqueous solution of sodium hydroxide (25% NaOH) at a temperature of 80° to 90° C. for about one hour during which time the polyester felt was dissolved away from the electrode structure.

What is claimed is:

1. A reticulate electrode for use in the electrolysis of aqueous solutions of ionizable compounds which comprises a network of electroconductive metal coated filaments, said filaments being selected from plastics of the group consisting of polyarylene sulfides, polyolefins produced from olefins having 2 to about 6 carbon atoms and their chloro- and fluoro- derivatives, nylon, melamine, acrylonitrile-butadiene-styrene (ABS), and mixtures thereof, said network having interfilament bonding at contact sites between adjacent filaments, and said reticulate electrode having a porosity of at least 90 percent.

2. The electrode of claim 1 in which said electroconductive metal is selected from the group consisting of nickel, nickel alloys, molybdenum, molybdenum alloys, cobalt, cobalt alloys, vanadium, vanadium alloys, tungsten, tungsten alloys, titanium, titanium alloys, gold, gold alloys, platinum group metals and platinum group metal alloys.

3. The electrode of claim 2 in which said metal coated filaments have a diameter in the range of from about 2 to about 200 microns.

4. The electrode of claim 3 in which said electroconductive metal is nickel or a nickel alloy.

5. The electrode of claim 4 or claim 14 in which said reticulate electrode has a porosity of from about 95 to about 98 percent.

6. In an electrolytic cell for the electrolysis of aqueous solutions of ionizable compounds, said cell having an anode assembly containing a plurality of anodes, a cathode assembly having a plurality of cathodes, a diaphragm or membrane separating said anode assembly from said cathode assembly, and a cell body housing said anode assembly and said cathode assembly, the improvement which comprises employing as said cathodes the electrode of claim 4.

7. The electrolytic cell of claim 6 adapted to electrolyze aqueous solutions of ionizable compounds selected from the group consisting of alkali metal chlorides and alkali metal hydroxides.

8. The electrode of claim 3 in which said electroconductive metal is titanium or an alloy of titanium.

9. The electrode of claim 8 in which said electroconductive metal has a coating of a platinum group metal or an alloy of a platinum group metal.

10. The electrode of claim 2 in which said filaments are comprised of a plastic selected from the group consisting of polyarylene sulfides, polyolefins produced from olefins having 2 to about 6 carbon atoms and their chloro- and fluoro- derivatives, and nylon, said plastics being sensitized by a metal selected from the group consisting of silver, aluminum or palladium.

11. The electrode of claim 10 in which said filament is nylon and said metal is silver.

* * * * *

UNITED STATES PATENT AND TRADEMARK OFFICE

CERTIFICATE OF CORRECTION

PATENT NO. : 4,370,214

DATED : January 25, 1983

INVENTOR(S) : Igor V. Kadija

It is certified that error appears in the above-identified patent and that said Letters Patent is hereby corrected as shown below:

On the title page, in the Abstract, line 5, delete "deposted" and insert --deposited--.

Column 3, line 28, after "and" (second occurrence), delete "pl" and insert --platinum group metals and their alloys. It is further preferred that--.

Column 4, line 56, after "in" insert --cells which electrolyze alkali metal chloride brines to produce alkali metal chlorates or cells which produce hydrogen or oxygen--.

Column 6, Claim 5, line 1, delete "14" and insert --9--.

Signed and Sealed this

Twelfth Day of April 1983

[SEAL]

*Attest:*

GERALD J. MOSSINGHOFF

*Attesting Officer*

*Commissioner of Patents and Trademarks*